US008066046B2

(12) United States Patent
Ballarotti

(10) Patent No.: US 8,066,046 B2
(45) Date of Patent: Nov. 29, 2011

(54) CUTTING AND TRANSFER DRUM IN A CONTINOUS-FILM LABELING MACHINE

(75) Inventor: Mario Ballarotti, Marmirolo (IT)

(73) Assignee: P.E. Labellers S.p.A., Porto Mantovano (IT)

( * ) Notice: Subject to any disclaimer, the term of this patent is extended or adjusted under 35 U.S.C. 154(b) by 423 days.

(21) Appl. No.: 12/448,140

(22) PCT Filed: Dec. 6, 2007

(86) PCT No.: PCT/EP2007/010588

§ 371 (c)(1),
(2), (4) Date: Jun. 10, 2009

(87) PCT Pub. No.: WO2008/077457

PCT Pub. Date: Jul. 3, 2008

(65) Prior Publication Data

US 2010/0018650 A1 Jan. 28, 2010

(30) Foreign Application Priority Data

Dec. 22, 2006 (IT) ..... MN2006A0075

(51) Int. Cl.
*B65C 9/04* (2006.01)

(52) U.S. Cl. ..... 156/446; 156/556; 156/457; 156/567; 156/361; 156/542; 156/521; 156/566

(58) Field of Classification Search ..... 156/446, 156/457, 567, 557, 361, 566, 542, 556, 521, 156/DIG. 9, DIG. 25, DIG. 12
See application file for complete search history.

(56) References Cited

U.S. PATENT DOCUMENTS

| | | | | |
|---|---|---|---|---|
| 4,735,668 | A | 4/1988 | Hoffmann et al. | |
| 4,758,300 | A | 7/1988 | King et al. | |
| 5,964,975 | A * | 10/1999 | Hinton | 156/215 |
| 6,328,832 | B1 * | 12/2001 | Otruba et al. | 156/64 |
| 6,668,518 | B2 * | 12/2003 | Rea | 53/134.2 |
| 2002/0029856 | A1 | 3/2002 | Gonzalo | |

* cited by examiner

*Primary Examiner* — Khanh P Nguyen
*Assistant Examiner* — Keith Aziz
(74) *Attorney, Agent, or Firm* — Modiano & Associati; Albert Josif; Daniel O'Byrne

(57) ABSTRACT

A cutting and transfer drum in a continuous-film labeling machine, which allows disassembly into sectors comprised between two contiguous blades, each sector being provided with elements for locking in the active position, which comprise a rotating rod which is provided with an actuation crank, said rod having a portion which is adapted to mate with a reference element provided on the sector, elements adapted to retain the sector in the locking position, a cam adapted to make contact with an abutment provided on the sector, so as to ensure a contact pressure of the sector on a supporting ring which ensures the retention of the fluid that provides suction.

3 Claims, 3 Drawing Sheets

CUTTING AND TRANSFER DRUM IN A CONTINOUS-FILM LABELING MACHINE

The present invention relates to a cutting and transfer drum in a continuous-film labeling machine.

BACKGROUND ART

Labeling machines are known which are designed to apply to containers labels printed on a continuous film wound on a reel: such film can have portions of paste which are preapplied to the labels at the face designed to make contact with the containers but can also have no preapplied paste, and in this case the machine has a pasting assembly.

Such machines comprise a rotating carousel provided with means for supporting the individual containers, which are adapted to turn the containers about their own axis, and the continuous film that unwinds from the reel then passes at an alignment device, at a label transit detection photocell, and at a traction roller.

At the output of the traction roller, the film is taken by a drum which comprises blades designed to cut the film at the separation notches between one label and the next and is provided, at its outer surface, with ports connected to suction means which ensure the retention of the film so that it adheres to the surface: in this manner, the individual labels, separated after cutting, are brought into contact with corresponding containers supported by the carousel.

Such drum is indeed termed cutting and transfer drum.

Known cutting and transfer drums can be divided into sectors, each of which covers a portion of a circumference which is comprised between two contiguous blades, and such sectors have some disadvantageous characteristics: the operations for locking and releasing them, which have to be performed every time the label processed by the machine is changed, are in fact awkward, and the correct positioning of the sectors is also often problematic.

It is also necessary to consider the fact that if blades of the known type which operate in combination with a contrast blade are used, only two blades can be installed on the drum.

SUMMARY OF THE INVENTION

The aim of the present invention is to provide a cutting and transfer drum in which the operation for locking and releasing the sectors is very easy and which can carry a large number of blades.

This aim is achieved by a cutting and transfer drum in a continuous-film labeling machine, according to the invention, characterized in that it comprises the features given in the appended claims.

BRIEF DESCRIPTION OF THE DRAWINGS

Further characteristics and advantages will become better apparent from the description of a preferred but not exclusive embodiment of the invention, illustrated by way of nonlimiting example in the accompanying drawings, wherein.

DESCRIPTION OF THE PREFERRED EMBODIMENTS

Figure 1:
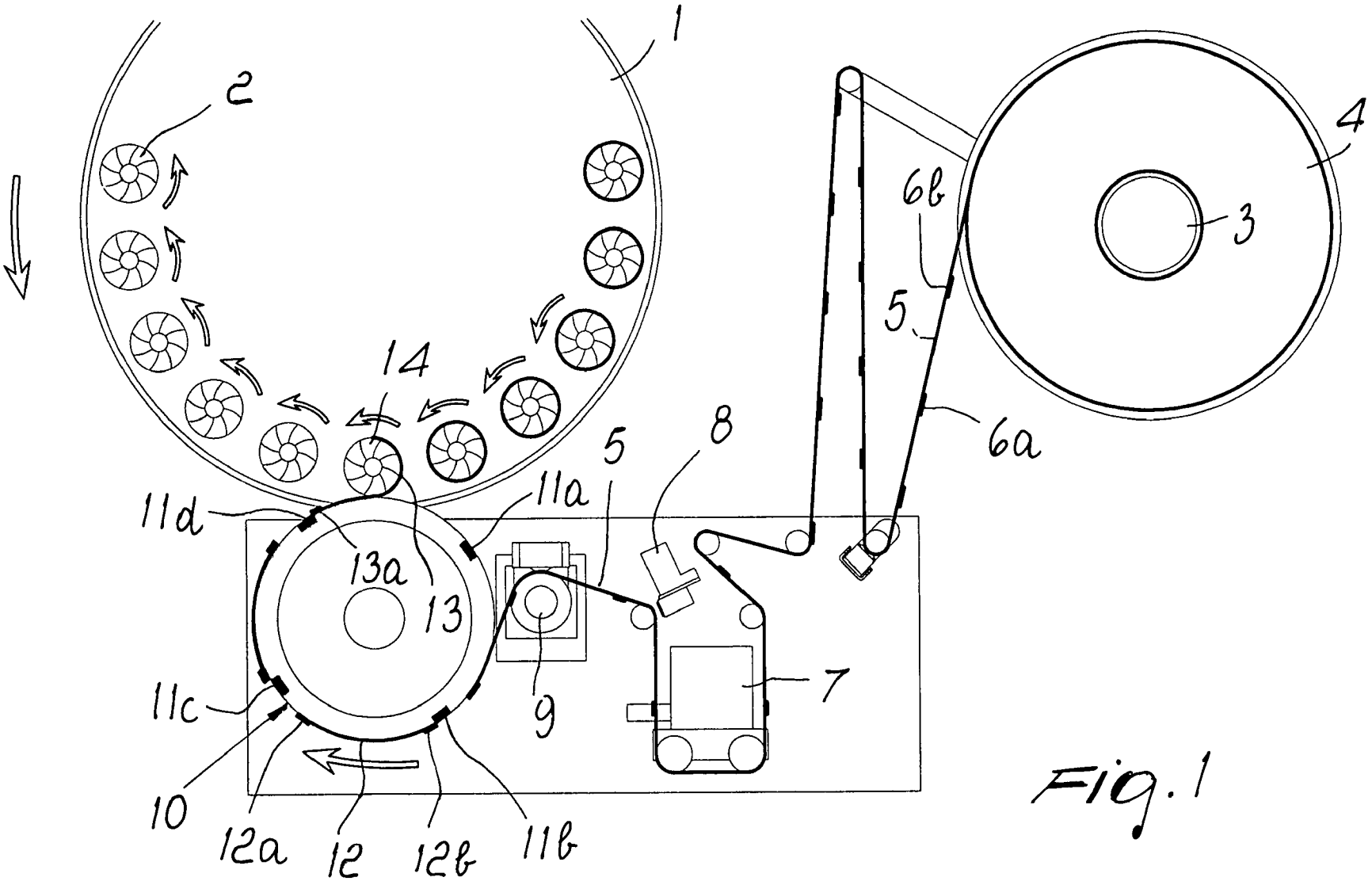
FIG. 1 is a schematic plan view of a labeling machine comprising the drum according to the invention.

With reference to FIG. 1, the reference numeral 1 designates a carousel of a labeling machine, which turns in the direction of the arrow and is provided with means for supporting individual containers 2 which are turned about their own axis.

The reference numeral 3 designates an axis for supporting a reel 4 of a film 5 which has the labels printed continuously thereon and is provided with preapplied portions of paste 6*a*, 6*b* at the leading and trailing edges of each label.

In unwinding from the reel 4, the film 5 passes, after a few changes of direction for tensioning, at an alignment device 7, at a photocell 8 for detecting the passage of labels, and at a traction roller 9.

All the rollers in contact with the pasted side of the film 5 have a non-stick treatment.

The reference numeral 10 generally designates a cutting and transfer drum designed to receive the film 5 in output from the traction roller 9, which will be described in detail with reference to FIGS. 2 and 3. Such drum is provided with four blades arranged in the positions 11*a*, 11*b*, 11*c*, 11*d* shown in FIG. 1 and therefore at the said drum first of all the individual labels are cut, such as for example the one that has just been cut, designated by the reference numeral 12, with portions of paste 12*a*, 12*b* at its leading and trailing edges, which continue to adhere to the drum by means of a suction device with which the drum is provided, and then the labels are transferred to the corresponding containers, as shown for label 13, which is applied to a container 14 and remains fixed by means of the portions of paste provided at the leading edge and trailing edge, the latter being designated by the reference numeral 13*a*, of the label at the face directed toward the container.

It is noted that as regards the drum according to the invention, nothing would change if, instead of being required to process pre-pasted labels, it were required to process labels designed to be spread with paste by an appropriately provided assembly located at such drum.

Figure 2:
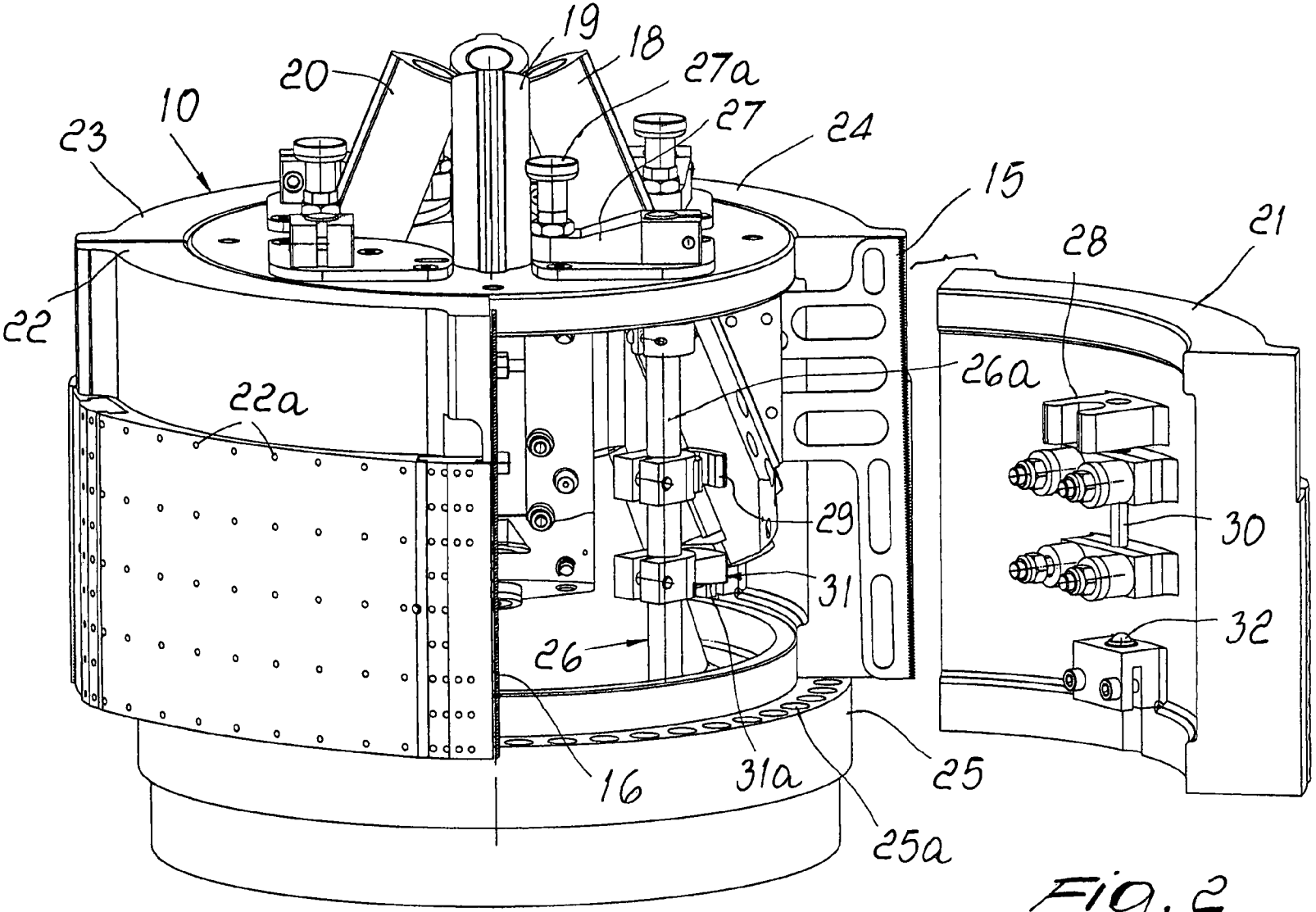
FIG. 2 is a view of the drum according to the invention with one of the sectors removed from the working position.
Figure 3:
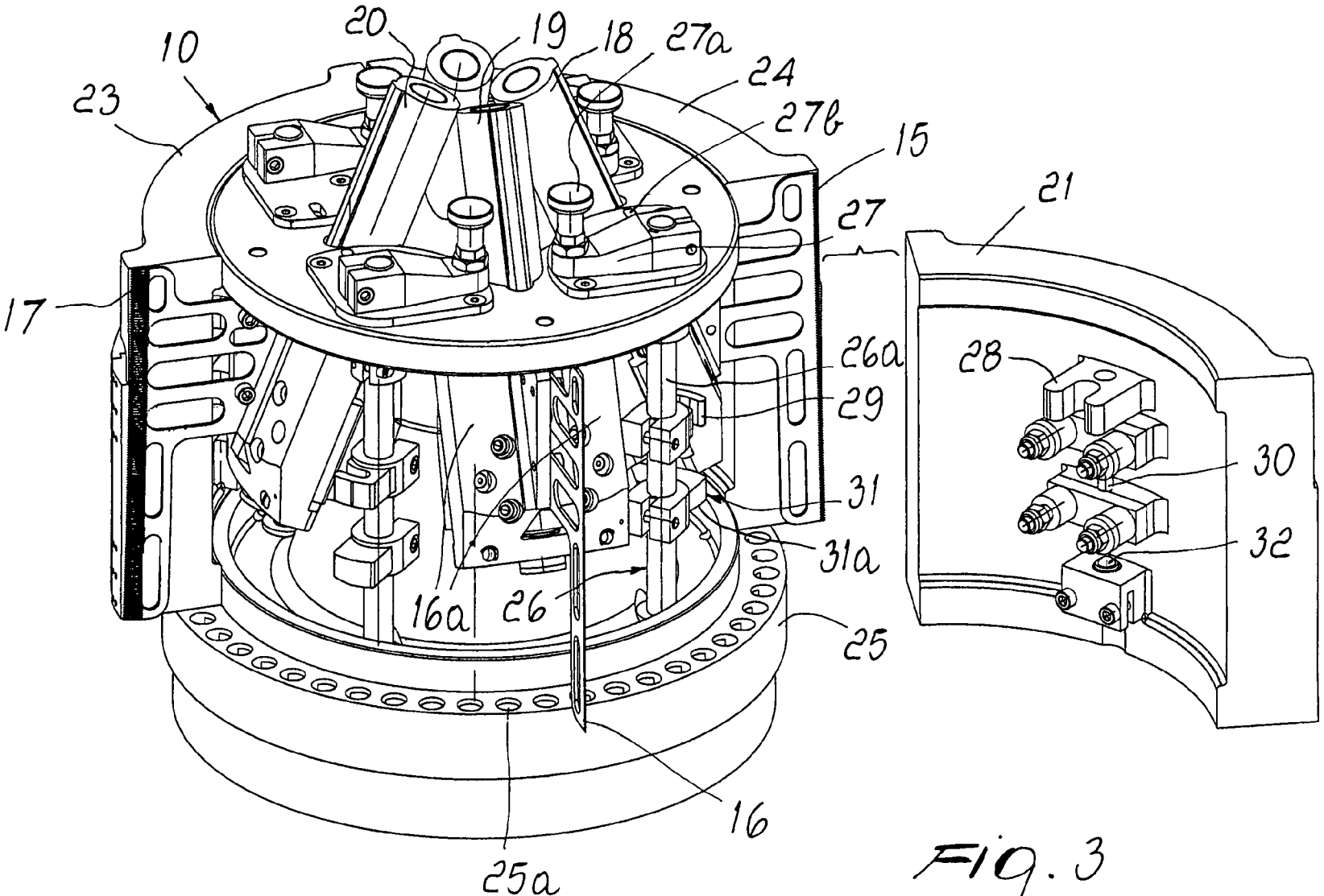
FIG. 3 is a view of the drum according to the invention without two sectors, only one of which is shown to the side.

In FIGS. 2 and 3, the drum 10 is shown, in which the reference numerals 15, 16, 17 designate the blades provided at the positions designated respectively by the reference numerals 11*a*, 11*b* and 11*c* in FIG. 1.

Such blades, each supported by a structure such as 16*a* for the blade 16 and actuated by actuation cylinders 18, 19 and 20 respectively, are of the type which works without contrast and is disclosed in a patent application by the same Applicant.

In the portions of circumference comprised between the blades 15 and 16 and between the blades 16 and 17 there are respectively the drum sectors 21 and 22, clearly shown in the figures, and the drum 10 is completed by identical sectors 23, 24.

Such sectors are provided with ports such as 22*a* for the sector 22 and rest on a ring 25 provided with suction ducts 25*a*, which are adapted to be connected to the ports 22*a* in order to retain the film 5 and the labels so that they cling to the sectors.

Each sector is provided with means for removable locking in the working position, which are independent and identical for the individual sectors and are now described in detail with reference to sector 21.

Such means comprise a rod 26, which is associated rotatably with the drum and is provided with a crank 27 for manual actuation between the extreme position for disengaging the sector, shown in FIGS. 2 and 3, and an extreme position for locking the sector; with reference to the locking means of the sector 22, we note that these two extreme positions are those shown in FIGS. 2 and 3 respectively.

Reverting to the means for locking the sector 21, in such extreme positions an elastic pin actuated by a knob 27*a* enters reference holes, only one of which, specifically the one related to the locking position of the sector 21, is visible and designated by the reference numeral 27*b* in FIG. 3.

The rod 26 first of all has a portion 26*a*, which is adapted to mate with a reference element 28 provided on sector 21 to provide centering in the positioning of such sector.

On the rod 26 there are also means adapted to retain the sector 21 in the extreme locking position, such means comprising a hook 29 associated with such rod and adapted to engage a bar 30 associated with the sector 21.

Finally, the rod 26 has a cam 31 associated therewith; such cam is adapted to make contact, by means of its active surface 31*a*, with an abutment element 32 provided on the sector 21, so as to ensure a contact pressure of such sector on the supporting ring 25 which ensures the retention of the fluid that provides suction.

From all of the above, optimization of the operations for locking and releasing the drum sectors is evident.

The described invention is susceptible of numerous modifications and variations, all of which are within the scope of the appended claims; all the details may further be replaced with other technically equivalent elements.

The disclosures in Italian Patent Application No. MN2006A000075 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A cutting and transfer drum in a continuous-film labeling machine, said drum being provided with blades designed to cut a film and with ports at the outer surface which are connected to suction means so as to ensure the retention of said film so that it adheres to said surface, said drum allowing disassembly into sectors each of which covers a portion of circumference which is comprised between two contiguous blades, wherein each sector is provided with means for removable locking in the active position, in which it rests on a ring provided with suction ducts which are adapted to connect to said ports provided at the outer surface, said means comprising a rod which is associated with said drum so that it can rotate and is provided with a crank for actuation between two extreme positions, respectively for locking and releasing the sector, said rod having:

a portion which is adapted to mate with a reference element provided on the sector in order to center the positioning of said sector;

means adapted to retain the sector in the extreme locking position of said sector;

a cam adapted to make contact with an abutment element provided on the sector, so as to ensure a contact pressure of said sector on the supporting ring which ensures the retention of the fluid that provides suction.

2. The drum according to claim 1, wherein the means adapted to retain the sector in the extreme locking position comprise a hook which is associated with said rod and is adapted to engage a bar associated with said sector.

3. The drum according to claim 1, wherein the blades are of the type which works without contrast.

* * * * *